US008021489B2

(12) United States Patent
Jackson

(10) Patent No.: US 8,021,489 B2
(45) Date of Patent: Sep. 20, 2011

(54) SUBSTRATE TREATMENT PROCESS

(76) Inventor: David P. Jackson, Saugus, CA (US)

( * ) Notice: Subject to any disclaimer, the term of this patent is extended or adjusted under 35 U.S.C. 154(b) by 0 days.

(21) Appl. No.: 13/016,836

(22) Filed: Jan. 28, 2011

(65) Prior Publication Data

US 2011/0132395 A1 Jun. 9, 2011

Related U.S. Application Data

(62) Division of application No. 11/465,762, filed on Aug. 18, 2006, now Pat. No. 7,901,540, which is a division of application No. 10/362,598, filed as application No. PCT/US01/26546 on Aug. 23, 2001, now abandoned.

(60) Provisional application No. 60/226,882, filed on Aug. 23, 2000.

(51) Int. Cl.
*B08B 7/04* (2006.01)
*B08B 7/00* (2006.01)

(52) U.S. Cl. ..... 134/1.1; 134/1; 134/1.3; 134/18

(58) Field of Classification Search ..... 134/1, 1.1, 134/1.3, 18; 156/345.39, 345.43, 345.47, 156/345.48; 427/569; 219/48, 5, 121.52
See application file for complete search history.

(56) References Cited

U.S. PATENT DOCUMENTS 4,762,977 A * 8/1988 Browning ..... 219/121.47
5,013,366 A * 5/1991 Jackson et al. ..... 134/1
5,054,421 A * 10/1991 Ito et al. ..... 118/723 HC
5,326,406 A * 7/1994 Kaneko et al. ..... 134/1
5,368,171 A * 11/1994 Jackson ..... 134/147
5,403,621 A * 4/1995 Jackson et al. ..... 427/255.39
5,660,743 A * 8/1997 Nemchinsky ..... 219/121.5
5,782,253 A * 7/1998 Cates et al. ..... 134/105
5,868,862 A * 2/1999 Douglas et al. ..... 134/26
5,908,510 A * 6/1999 McCullough et al. ..... 134/2
5,967,156 A * 10/1999 Rose et al. ..... 134/7
6,057,414 A * 5/2000 Razavi ..... 427/491
6,121,572 A * 9/2000 Holste et al. ..... 219/121.59
6,180,031 B1 * 1/2001 Bawa et al. ..... 264/1.1
6,194,036 B1 * 2/2001 Babayan et al. ..... 427/563
6,228,563 B1 * 5/2001 Starov et al. ..... 430/327
6,240,936 B1 * 6/2001 DeSimone et al. ..... 134/33
6,242,165 B1 * 6/2001 Vaartstra ..... 430/329
6,262,386 B1 * 7/2001 Fornsel ..... 219/121.52
6,355,312 B1 * 3/2002 Fornsel et al. ..... 427/565
6,958,063 B1 * 10/2005 Soll et al. ..... 606/41
7,901,540 B2 * 3/2011 Jackson ..... 156/345.39
2002/0179575 A1 * 12/2002 Fornsel et al. ..... 219/121.5

* cited by examiner

*Primary Examiner* — Alexander Markoff
(74) *Attorney, Agent, or Firm* — DuFault Law Firm, P.C.; Dustin R. DuFault

(57) ABSTRACT

A method of forming a plasma to physicochemically modify properties of a fluid spray in a substrate treatment processes includes providing an applicator in proximity to the substrate. The applicator comprises an electrically insulated main body portion containing a cavity, a tube axially positioned within the cavity for transporting a first fluid, an annular electric-field generator positioned within the cavity between the main body portion and the tube, a region between the tube and the generator for transporting a second fluid, and a nozzle connected to the main body portion for mixing the first fluid with the second fluid to form the fluid spray. The tube, the nozzle or the substrate are selectively grounded. Upon activating the electric-field generator, plasma is formed within the tube or about the region between the tube and the generator when the tube is grounded, within the nozzle when the nozzle is grounded or between the nozzle and the substrate when the substrate is grounded.

13 Claims, 9 Drawing Sheets

EXEMPLARY DENSE FLUID PLASMA NOZZLE USING PLASMA FIELD

FRONT END PARTIAL VIEW

EXEMPLARY DENSE FLUID PLASMA GENERATION

EXEMPLARY DENSE FLUID PLASMA SPRAY SYSTEM

EXEMPLARY DENSE FLUID SPRAY WITH INTEGRATED EXTRACTION SHROUD

EXEMPLARY SNOW-OZONE GENERATION AND APPLICATION SYSTEM USING CORONA PLASMA

EXEMPLARY DENSE FLUID SNOW-OZONE GENERATION AND APPLICATION SYSTEM USING UV RADIATION

EXEMPLARY DENSE FLUID-MICROABRASIVE MEDIA GENERATION AND APPLICATION SYSTEM

EXEMPLARY ALTERNATIVE CLEANING AND SURFACE MODIFICATION METHODS

SUBSTRATE TREATMENT PROCESS

CROSS-REFERENCE TO RELATED APPLICATION(S)

This application is a Divisional of U.S. patent application Ser. No. 11/465,762 entitled Dense Fluid Delivery apparatus filed on 18 Aug. 2006, which was a Divisional of U.S. patent application Ser. No. 10/362,598 entitled Surface Cleaning and Modification Process, Methods and Apparatus Using Physicochemically Modified Dense Fluid Spray filed on 13 Jun. 2003 which was a National Phase Application of PCT/US01/26546 of the same title filed on 23 Aug. 2001 which claimed the benefit of U.S. Provisional Application No. 60/226,882 of the same title filed on 23 Aug. 2000, each of which is hereby incorporated herein by reference.

BACKGROUND OF INVENTION

The present invention relates in general to a cleaning spray system which employs a solid carbon dioxide (snow) spray mixture stream, physicochemically modified to contain reactive inorganic gaseous species, which is directed at variable velocity, spray temperatures, and pressures onto substrate surfaces of components or articles that require cleaning and substrate treatment to allow for better bonding, gluing, markability, paintability, coatability or pottability. Various embodiments are incorporated herein which enhance the utility of the present invention.

The joining or bonding of substrates is a surface phenomenon, therefore surface preparation prior to bonding is critical for successful bonding. The sole purpose of surface preparation is to attain adherend surfaces receptive to the development of strong, durable bonded joints. It is desirable to have the basic adherend material (clean native substrate surface) exposed directly to the bonding agent (i.e., adhesive), coating agent (i.e., thin film), soldering agent (i.e., molten solder) or, in the case of acoustic: welding, a second clean and treated adherend. The absence of a second intervening layer such as an oxide film, particle, coating or release agent is often desirable. Conventional surface preparation processes for bonding typically involves two separate substrate surface treatments as follows: 1) surface cleaning to remove gross or trace surface contamination such as old coatings and paint and/or thin film hydrocarbons and particulates, and 2 surface modification to increase surface free energy (wetting) to promote contact between newly applied bonding agents and adherends. Achieving adequate adhesion to polymeric (organic), ceramic, glass and metallic (inorganic) adherends is a recurring and difficult problem throughout many industries. Many cleaning and modification processes have been developed and are discussed below.

Historically, various surface treatments have been used to improve the adhesion of coating or bonding agents to plastics. These include flame treatment, mechanical abrasion, solvent cleaning or swelling followed by wet chemical etching, or the application of specialized coatings in the form of chemical primers. Often what works for one specific application will not be effective for another, thus specific treatments need to be developed for each. For example, flame surface treatments present fire hazards and may damage heat-sensitive substrates. Solvent cleaning employing hazardous organic solvents such as acetone, toluene and methyl ethyl ketone (MEK) and acid or alkaline etching solutions present flammability, operator safety and/or ecological hazards, or may damage the substrate. Mechanical abrasion creates a particle aid residue clean-up issue and may damage critical surface topography. Moreover, the use of chemical primers requires specialized formulations for each type of polymer substrate.

Ceramics, pyroceramics and glasses are scrubbed with Ajax cleanser, or equivalent abrasive cleaner, rinsed with deionized or distilled water and dried at 120 to 150 F. Metallic substrates may be solvent cleaned using xylene, methyl ethyl ketone (MEK), or isopropyl alcohol (IPA) and air dried. Bare copper alloys are typically vapor degreased to remove gross soils, dipped in a nitric acid/ferric chloride solution to remove metallic oxides, rinsed with tap water to remove cleaning agents, spray rinsed with deionized water and finally air dried at 120 to 150 F. Alternatively, bare copper may be abrasively blasted with silica particles to remove metallic oxides, rinsed with deionized water to remove abrasives, and air dried at 120 to 150 F. Fluorinated polymers are wiped with acetone to remove gross surface contaminants, treated with sodium-napthalene solution, rinsed with acetone rinsed with deionized water to remove acetone residues and air dried at 100 F. Other common substrate treatment solutions include an FPL etch, which is a sulfuric aciddichromate pickling solution, and alkaline treatments such as sodium hydroxide-ferricyanide solutions. With some polymeric substrates, an extended strong organic solvent soak is necessary to produce a high energy surface layer which can be wetted by an adhesive or coating.

Consistent surface modification requires, in most cases, a fairly clean substrate—free of gross hydrocarbon contaminants and monolayers present on the uppermost surface layers. However, this requires performing a cleaning step independent of and prior to surface treatment. For example, solvent cleaning is acceptable for cleaning most substrates free of organic contaminants but has limited utility where a distinct change in the chemical nature of the substrate surface is required.

Where chemical treatments cannot be used due to part geometry, sensitivity or compatibility, and/or environmental risk, plasma etch techniques may be employed. However, a typical pretreatment prior to plasma etch is to remove oil, grease and other surface contaminants using an organic solvent such as 1,1,1 trichloroethane, toluene or MEK. Following this, the substrate is exposed to a gas plasma for 5 to 10 minutes at between 1 and 10 watts/cu.in. and under atmospheres of between 1 to 2 torr comprising oxygen, argon or water vapor and mixtures thereof.

Moreover, sand blasting, sand paper, abrasive pads or other mechanical abrasion techniques may be employed in place of chemical treatments. Similar to plasma etch treatments discussed above, the substrate must be degreased prior to mechanical abrasion, and following treatment, the residual abrasive agents must be removed from the surface. As such, multiple and separate steps are required to clean and prepare a substrate surface for bonding operations. Although, mechanical abrasion will remove hardened surface layers such as old polymeric coatings, paint, adhesives and metal oxides, it may not necessarily adequately treat the underlying exposed substrate surface. For example, activated plasma treatments discussed above using oxygen argon or water vapor plasma have demonstrated bond strengths three to four times that of abrasive surface preparation techniques. As such, both of these surface cleaning and treatment methods may have to be used in sequential order to properly clean and modify a surface in preparation for bonding.

For example, a typical substrate surface cleaning and modification application is the removal of old conformal coatings, for example parylene (an organic polymeric coating used to hermetically seal an electronic package), to enable the replacement of an electrical component mounted on an electronic substrate (i.e., BGA de-soldering, replacement and resoldering operation). In this common rework application, the parylene coating covering the BGA is selectively stripped using a chemical or abrasive agent. Following this, the BGA is de-soldered from the surface, the surface is cleaned and modified to promote wetting by solder and new conformal coating. A replacement component is re-soldered, and a new coating of parylene is applied and cured. This is exemplary of commercial production practices that require the iterative steps of stripping, cleaning, and modification.

More energetic, ecologically-friendly and worker-safe alternatives have been developed. These include, high energy density treatments such as ultraviolet (UV) radiation (with/without ozone) and atmospheric plasma have gained greater acceptance on a larger scale for substrate surface modification. They provide a medium rich in reactive species, such as energetic photons, electrons, free radicals, and ions, which, in turn, interact with the polymer or metallic substrate surface, changing its surface chemistry and/or morphology. However, these newer processes require that the substrate be free of gross contamination, wherein some type of conventional surface cleaning process is still required prior to use of these high energy surface modification processes. One example of a conventional surface modification system is the PT-2000 Plasma Treatment System from Tri-Star Technologies, El Segundo, Calif. The device uses a supply of nitrogen, argon, oxygen and/or other gases, singularly or in combination, in combination with an electrical corona generator and suitable corona forming nozzles to create a gas jet plasma or atmospheric plasma stream. The atmospheric plasma stream is then directed at a substrate thereby modifying its surface—creating high surface free energy and implanting functional groups into the surface layers, depending upon the plasma gas phase chemistry used. Different plasma gases and gas mixtures provide different surface properties. As such, the desired surface treatment can often be optimized for a particular surface, and bonding process. Recommended pre-cleaning of the surface is either a solvent wipe or aqueous wash and dry.

An example of an energetic surface cleaning and modification technique is given in U.S. Pat. No. 5,054,421, Ito, et al. In this process, a substrate is cleaned using a gas jet which is simultaneously irradiated with an electron beam. The gas molecule are excited through the creation of a glow discharge (plasma), following which the reactive gas mixture is contacted with the substrate. A voltage of up to 2000 volts may be applied between two electrodes to produce the glow discharge. The process is performed under a depressurized condition, 0.1 to 10 mm Hg vacuum, and elevated temperatures using various inorganic and organic gases and mixtures, for example silane and oxygen. An electric field imparts momentum and accelerates the reactive gas mixture, under vacuum, at the substrate surface. The '421 process teaches both cleaning and coating the substrate with thin films (i.e., silicon) using the invention. The process as taught is performed under low pressure conditions to impart ionization to the cleaning gases (i.e., oxygen—O.sub.2) or thin film forming gas (i.e., silane—SiH.sub.4). The main drawbacks with this invention as it relates to surface cleaning and treatment is that it must be performed within a vacuum environment, necessitating the use of expensive vacuum chambers, pumps and environmental controls. As with most conventional vacuum plasma cleaning processes, the substrate surface must be significantly absent of gross hydrocarbon contaminants to prevent the contamination of the vacuum environment and to allow the reactive gases to contact the underlying substrate surface.

From the above, it can be seen that a method and apparatus for cleaning and treating various medical, electronic and mechanical substrates that offers enhanced cleaning and surface modification under standard temperature and pressure conditions, and is safe, easy, and reliable and can be easily integrated with automation and control systems for inline production applications is often desired. Moreover, it is desirable to have a process, method and apparatus that can be integrated with conventional bonding agents and/or processes to allow for in-situ surface cleaning and modification with bonding, coating, painting and curing. As such, there is a present need to provide processes, methods and apparatus for simultaneously cleaning and modifying a substrate surface in preparation for bonding, gluing, marking, painting, coating, potting and curing.

SUMMARY OF THE INVENTION

The present invention overcomes the deficiencies of prior art cleaning systems by providing processes, methods and apparatus for simultaneous cleaning and treating a substrate surface, irrespective of the initial and in-process substrate surface and particulate contamination levels. Moreover, the present invention can be applied under atmospheric or greater pressure and temperature conditions to a variety of substrates having complex topography. The present invention was developed to prepare a variety of substrates for structural joining—for example adhesive bonding, TIG/MIG/Acoustic welding, soldering, painting and/or coating and curing. However, it may be used for any number of substrate treatments requiring a high degree of cleanliness and/or high surface energy, for example, cleaning and sterilizing medical device substrate surfaces such as syringe needles and bodies, catheters, pacemakers and the like.

In summary, the present invention provides a variety of processes, methods and apparatus for providing a variety of cleaning and modification spray treatments. The present invention provides the simultaneous steps of 1) selectively removing one or more unwanted surface contaminants, including extremely hard coatings, 2) exposing a native clean surface layer and 3) modifying said exposed and cleaned native substrate surface layer to energetic radicals and radiation to improve adhesion, wettability or coatability. Reactive species in combination with non-reactive, but chemically or physically active, species provide a rich reaction control environment by which contaminants and surface layers are oxidatively, physically and chemically destroyed and entrained to prepare the substrate surface for subsequent bonding, deposition, coating and curing operations. Substrates treated in accordance with the present invention have clearer and higher surface free energy surfaces.

Embodiments of the present invention disclosed herein include, but are not limited to, the following: creating a combination of reactive oxidative or reductive species (reactive gases and by-product radiation) and non-reactive species (solid particles) in a composite surface cleaning and modification stream; providing a mechanism for simultaneously removing gross coating, particle, ionic, inorganic and organic contamination layers contained on the uppermost layers of a substrate surface, exposing the resulting contaminant-free substrate interlayers to reactive species and by-product ultraviolet radiation, continuously removing interlayer reaction by-products during continuous contact and providing environmental control within the reaction zone to optimize the reaction; providing a continuous source of cleaning energy (pressure shear, heat, reactants) within the propellant stream to enhance contaminant separation, reaction and in-situ localized environmental control; providing in-situ reactive species such as ozonated snow chemistry to greatly enhance contaminant-contaminant and contaminant-substrate bond destruction through pressure-enhanced oxidation; providing in-situ reaction heat dissipation using solid carbon dioxide sublimation energy; providing a method and apparatus for mixing small amounts of various microabrasives, some having static dissipative characteristics, into the propellant stream and mixed with snow particles to remove physically hard substrate surface layers such as polymeric coatings and metal oxide layers, and simultaneously using snow particles to remove said microabrasive and ablated coating particles; and providing design and operational characteristics that allow for automation and control of the present cleaning processes and integration with production tools such as surface inspection devices and adhesive dispensers, utilizing the present inventions in-situ UV curing embodiment.

DETAILED DESCRIPTION

Figure 1:
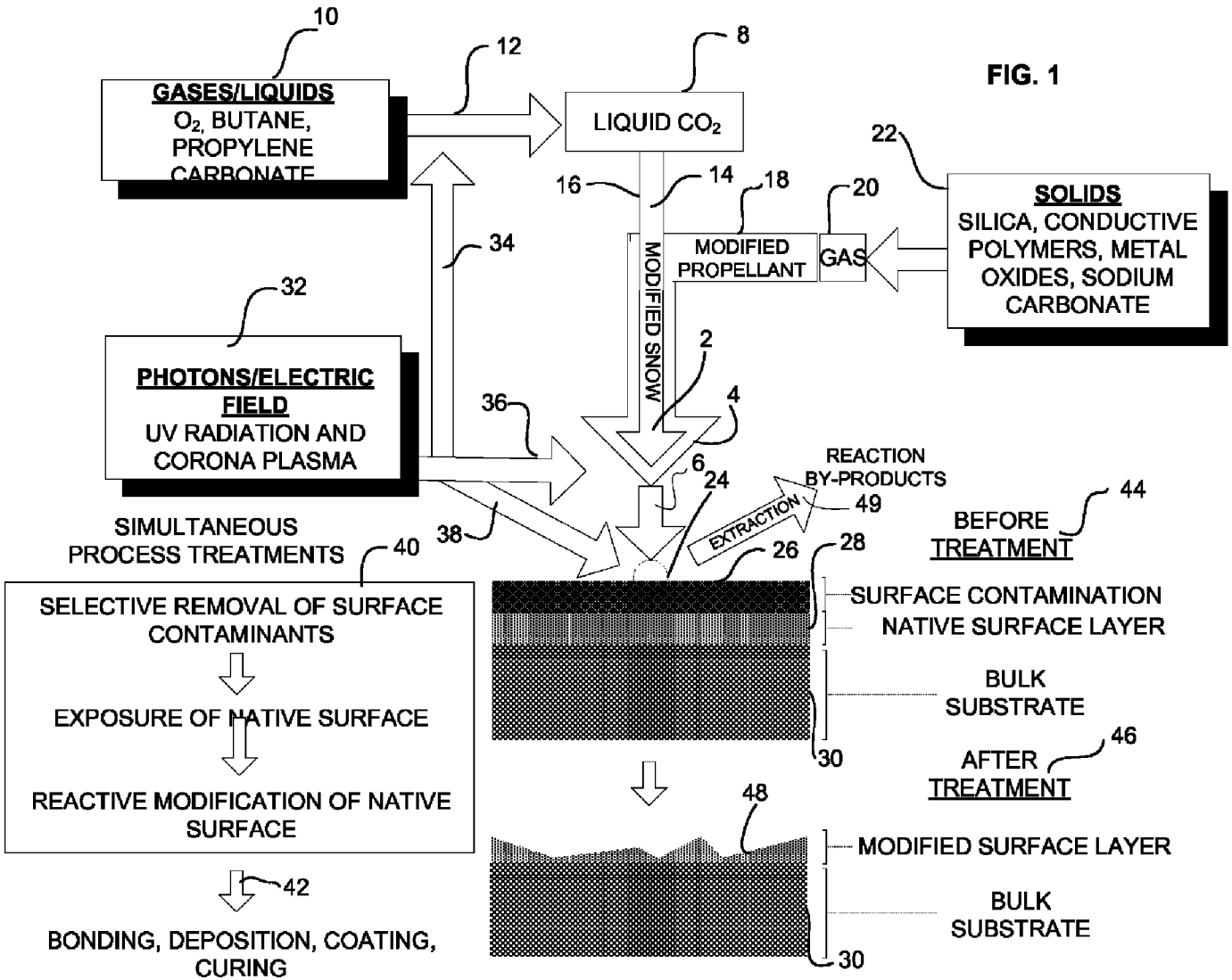
FIG. 1 is a schematic diagram of the exemplary dense fluid spray surface cleaning and modification process.

Turning now to a more detailed consideration of the preferred embodiments of the present invention, FIG. 1 illustrates a schematic diagram of the exemplary dense fluid spray surface cleaning and modification process. Referring to FIG. 1, the present invention employs three cleaning and modification streams including a modified solid carbon dioxide (snow) spray stream 2, a modified snow propellant (TIG—thermal inert gas) stream 4 and/or a modified TIG-Snow dense fluid cleaning and modification spray stream 6.

A modified snow spray stream 2 is generated as follows. Using a source of liquid carbon dioxide 8 which is physicochemically modified with various organic and/or inorganic gases or liquids 10, and mixtures thereof, including but not limited to, oxygen gas, n-butane gas, propylene carbonate liquid via injection 12 of said modifiers into said liquid carbon dioxide 8. Following this, the liquid carbon dioxide is condensed into a solid using an enhanced condensation process 14 developed by the present inventor, and discussed in detail in a pending patent application, thereby forming a dense solid carbon dioxide particle mixture encapsulating said modifiers in the form of solid-gas and/or solid-liquid matrices. The modified snow stream 2 is transported via a polymeric or metallic capillary tube 16 and into a coaxial assembly tube 18, which contains a modified snow propellant stream 4. The modified snow propellant stream 4 is generated as follows.

A source of propellant gas 20, which may include but is not limited to, oxygen, nitrogen, argon, helium, carbon dioxide, clean-dry-air and/or water vapor, and mixtures thereof, is optionally modified through the addition of a source of solid micro abrasive additive 22, which may include but is not limited to fine silica, conductive polymers, metal oxide, and/or sodium carbonate particles. The modified propellant stream 4 is fed coaxially with the modified snow stream 2, contained within a capillary feed tube 16, through an outer coaxial tube 18. An apparatus for coaxially delivering, mixing and propelling said modified mixtures is described in U.S. Pat. No. 5,725,154, which is hereby incorporated herein by reference.

The modified snow stream 2 and modified snow propellant stream 4 are mixed in a convergent-divergent nozzle assembly (not shown) to produce a modified and variable geometry (pressure, temperature and modifier concentration control) TIG-Snow surface cleaning and modifying spray stream 6. The modified TIG-Snow spray stream 6 is directed at a portion of a substrate, called the reaction site 24 herein, comprising the layers of surface contamination 26, native substrate surface layer 28 and bulk substrate 30. The temperature of the mixture is adjusted by adjusting the temperature of the propellant stream 4 using an in-line heater (not shown) and the pressure of the mixture is adjusted by adjusting the propellant stream 4 pressure using a pressure control gage (not shown). Temperature and pressure control features of the present invention are described in detail in the referenced the '154 patent invention and pending patent above.

The modified snow stream 2 and/or propellant stream 4 and/or TIG-Snow cleaning and modification stream 6 may be further modified using ultraviolet radiation and/or corona plasma 32 to produce reactive modifying agents or species to be contained therein. Reactive modifying agents used in the present invention comprise excited atomic, molecular, ionic and radical species—generated through the interaction of the entrained modifying constituents with an electric field, corona discharge or ultraviolet radiation. For example, an applied electric field having a field strength of between 5,000 and 25,000 volts as generated within an exemplary plasma spray nozzle, described in more detail later in this specification, to produce reactive species within the snow or propellant streams through the formation of a corona plasma. The corona treatment may be applied 34 to the liquid carbon dioxide modifiers 10, for example oxygen gas, to produce ozone as an additive injection into liquid carbon dioxide 8. The ozone is entrained within the condensed liquid carbon dioxide as a snow-ozone chemistry. In another example, a corona treatment may be applied 36 to the coaxial mixture of modified TICS-Snow spray mixture 6 containing argon and oxygen gases to produce a mixture of snow, ozone and excited argon radicals. Finally, the corona plasma may be applied 38 to the reaction site 24, and specifically the surface contamination layer 26 and native surface layer 28 in combination with the souring cleaning action of the impinging snow particles and modified propellant streams. Using this approach, a mixture of corona plasma, excited radicals, and impinging cleaning particles are produced at the reaction site 24 providing a very aggressive surface cleaning and modification enhancement.

Similarly, ultraviolet radiation may be applied as described above in place of or in combination with corona plasma to produce reactive species within the snow, propellant or reaction site. An exemplary ultraviolet radiation device used in the present invention is a pulsed ultraviolet radiation source, delivered from a xenon gas lamp via a light pipe and coupled with the spray streams, and having an energy output of between 1 and 3 joules/pulse at rate of between 100 and 150 pulses/second. Using this device, a UV rich spectrum of wavelengths can be produced in a single burst—from 100 to 400 nm and up to 200 watts/cm.sup.2. Ozone modifier is readily generated when oxygen is present within the liquid, solid and/or gas stream constituents of the present invention using high output within the 189.9 nm region of the radiation. The ultraviolet radiation embodiment has advantages over corona plasma treatment in applications where the substrate may be damaged by a direct corona plasma treatment 38 due to electrostatic discharge concerns. Also, in integrated cleaning, modifying and bonding applications of the present invention the ultraviolet radiation embodiment is used as an curing tool for a UV-curable coating, potting or adhesive bead that has been applied to the cleaned and treated substrata.

Following is an overview of the dense fluid spray cleaning and modification process itself. The process thus described comprises the following elements:

1. Physicochemical modification of a snow stream 2 using gases, liquids, UV radiation and/or corona plasma treatment an enhanced condensation reaction.

2. Physicochemical modification of a propellant (TIG) stream 4 using various gases and solids (microabrasives).

3. Physicochemical modification of a TIG-Snow cleaning and modification spray stream 6 using pressure and temperature control, corona plasma treatment, and/or ultraviolet radiation.

4. Physicochemical modification of the cleaning spray-substrate surface reaction site or interface 24 using pressure and temperature control, corona plasma and ultraviolet radiation treatment.

Moreover, the TIG-Snow cleaning and modification stream 6 and reaction site 24 have the following physicochemical make-up:

1. Oxidative species—ozone and excited molecular, atomic, ionic radical species;
2. Photons—ultraviolet radiation applied directly to substrate or applied indirectly as a by-product of corona plasma ion re association reactions.
3. Physical species—solid carbon dioxide particles provides chemical cleaning and scouring action, entrain and deliver modifiers, and cool plasma and UV reactions at reaction site. Microabrasives provide aggressive ablative cleaning action.
4. Temperature control—temperature of propellant stream may be adjusted from, for example, between 20 to 150 C.
5. Pressure control—pressure of impinging cleaning and modification spray be adjusted from, example, between 20 to 3000 psi.
6. Environmental control—modified propellant provides an artificial and reaction-enhancing environment, thereby excluding ambient atmosphere containing contaminating moisture and gases from reaction site.

The present invention provides a variety of processes, methods and apparatus for engineering a variety of cleaning and modification (treatment) sprays—providing the simultaneous steps as shown in process description block 40 of selectively removing one or more unwanted surface contaminants, including extremely hard coatings, exposing a native clean surface layer and modifying said exposed and cleaned native substrate surface layer to energetic radicals and radiation to improve adhesion, wettability or coatability. Reactive species in combination with non-reactive, but chemically or physically active, species provide a rich reaction control environment through which contaminants and surface layers are oxidatively, physically and chemically destroyed and entrained to prepare the substrate surface for subsequent bonding, deposition, coating and curing operations 42. As a result, before treatment 44 substrate interlayer chemistry differs markedly from after treatment 46 interlayer chemistry using the processes, methods and apparatus of the present invention. These include a much cleaner and higher surface free energy substrate surface 48.

Finally, reaction by-products of the present invention include various admixture gases and solids such as residual ozone gas, carbon dioxide, nitrogen, water vapor, and microabrasive particulates. These by-products may be extracted from the reaction site 24 under a vacuum exhaust stream 49 using a fume extraction hood (not shown) or novel integrated treatment and extraction nozzle designs of the present invention and described below. The extracted by-products may be further treated to destroy residual ozone and remove particle matter from the waste stream prior to discharge into the environment. The use of solid modifiers in the present invention is performed in a sequential or pulsed manner so that following admixturing and application, snow particles are used to remove residual microabrasives and ablated surface contamination and are then extracted from the reaction site as described above.

Turning to a discussion of the various and novel reaction kinetics and chemistries associated with the present invention. The addition of certain gaseous modifiers such as nitrogen gas, water vapor into the propellant stream and exposing said modified stream to high energy plasma or radiation produce, as a by-product, beneficial functional groups (i.e. —N, —OH) which are chemically bonded to the clean/modified substrate surface layers 48 which promote adhesion strength during subsequent bonding processes. Moreover, UV radiation is a by-product of corona plasma treatment through the re-association of electrically excited ions—emitting energetic photon energy during electron decay. UV radiation promotes new radical formation within the treatment streams, at the reaction site and reacts directly with organic surface contamination—breaking the contamination into more soluble or volatile species. The choice of solid modifiers is also important—a particular microabrasive is selected that when propelled at the reaction site, provides enough kinetic energy to selectively abate the contain nation (i.e., epoxy). The presence of reactive particles within the TIG-Snow stream greatly increases energy content, and resulting effect upon surface contamination and native surface layer. It is estimated that reactive particle densities within a corona plasma range from 1.times.10.sup.10 to 1.times.10.sup.12 reactive particles per cubic centimeter of reaction gas and reactive particle-substrate reaction interphase temperatures range from 1-3.times.10.sup.3 Kelvin, similar to acoustic surface cleaning phenomenon. It is believed that both high reactive species densities and intermolecular reaction temperatures of plasmas play the predominant role in surface treatment—a form of micro molecular oxidation and ablation. Delivery of these concentrated reactive species to the substrate, and specifically to a portion of a substrate, before they decay is imperative—the present invention utilizes a supersonic delivery and targeting means to optimize and control delivery of reactive species. The reactive dense fluid sprays of they present invention are directional and selective—providing both macro and micro molecular level surface cleaning and modification effects.

Moreover, snow particles used herein operate as an active surface cleaning agent, a modifier delivery vehicle (i.e., snow-ozone) and a cooling agent. Solid phase carbon dioxide is an excellent thin film hydrocarbon removal agent due to its dispersion chemistry and lyophilic behavior (Solubility Parameter—22 MPa.sup.1/2), similar to 1,1,1 trichloroethane. Adding compounds such as propylene carbonate and n-butane will greatly improve the solvency for various surface contaminants not easily solubilized in solid carbon dioxide alone. Also, chemical agent modifiers may be chosen which alter the tribocharging properties of solid phase carbon dioxide—thereby reducing or eliminating tribocharging phenomenon during contact with substrate surfaces. Moreover, incorporating an oxidative chemical such as ozone into the snow matrix provides a powerful cleaning agent combination—both chemical and oxidative cleaning actions. Moreover, dense solid carbon dioxide particles containing ozone impact a substrate at near-sonic or supersonic velocities—the kinetic energy imparted at the substrate surface-cleaning agent interface can be extremely large. It is possible to have the ozone phase contained within the solid carbon dioxide matrix (Snow Particle Temperature is −80 C.) to be compressed to above its liquefaction point, or at least heavily concentrated beyond normal atmospheric ozone gas treatments. This concentrated chemistry is driven into the solid phase matrix. This 'concentration effect', under great pressure, significantly enhances the reaction kinetics for ozone oxidation reactions and solubility-extraction of interphasic contaminants.

The present invention provides a variable-geometry spray, the constituents of which work in union, to selectively and simultaneously remove surface contamination and modify the underlying expose surface layers. For example snow particles removing lower molecular weight surface layers, microabrasives removing highly crystalline coatings and reactive species modifying exposed and clean surface layers.

Finally with respect to reaction site cooling, substrate cooling is enabled during application of corona plasma or UV radiation through sublimation heat extraction—preventing thermal damage to delicate substrates. Having thus described the process elements of the present invention, the following is a more detailed description of various apparatus used to practice the invention thus disclosed.

Figure 2:
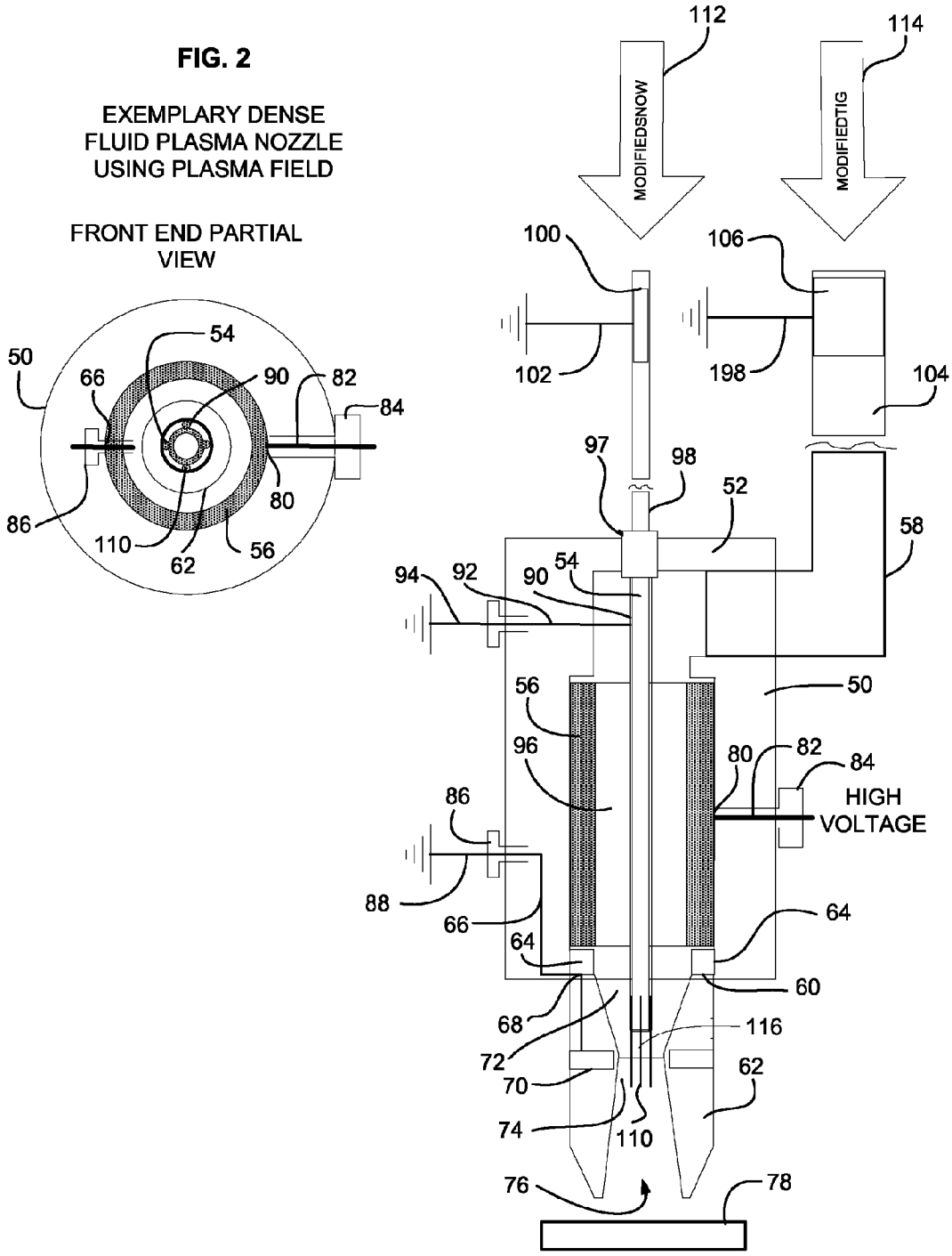
FIG. 2 is a schematic diagram of the exemplary dense fluid plasma nozzle.

FIG. 2 is a schematic cutaway diagram of an exemplary dense fluid plasma applicator using a corona plasma treatment. The exemplary applicator is a coaxial design comprising an electrically insulating and solid Teflon, PEEK or Delrin applicator body 50. The applicator body 50 is bored to have a central cavity 52 which contains centrally-located and electrically insulated snow tube assembly 54, an electric field generating ring 56 and is ported to affix a propellant injection tee 58. Affixed to the front end 60 of the applicator body 50 is a convergent-divergent mixing nozzle 62 using a threaded connection scheme (not shown). The mixing nozzle 62 is electrically isolated from the electric field generating ring 56 using a suitably sized non-conductive Teflon spacer ring 64. The mixing nozzle 62 may be non-conductive or conductive and may be wholly or partially, or not, grounded to earth ground via a grounding electrode wire 66 which intimates with the mixing nozzle at an interface 68 between the insulating spacer ring 64 and the mixing nozzle 62. If the nozzle 62 is metallic or semi-conductive, electric charges will exchange between the grounding electrode wire and the mixing nozzle 62. Alternatively, the mixing nozzle 62 may be constructed to be semi-conductive with an electrically insulating material housing a metallic conductor 70 at some location along the vertical sections of the cutaway mixing nozzle 62 which is in communication with the electrical grounding wire 66 through an interconnecting conductor wire 72 in communication with the grounding interface 68. Using these design approaches the mixing nozzle can be constructed to 100% un-grounded (all non-conductive), 100% full-grounded (all conductive) or selectively or locally grounded. The semi-conductive design is useful for selectively developing a corona plasma within the propellant stream zone 72 or within the TIG-Snow spray zone. The conductive design is useful for developing a corona plasma within the TIG-Snow spray zone 74 and between the mixing nozzle opening 76 and the substrate 78 being treated. The non-conductive design is useful for developing a corona plasma between the mixing nozzle opening 76 and the substrate 78 being treated. Furthermore, the electric field generating ring 56 is connected 80 to a high voltage conductor wire 82 using a suitable electrically insulating connector 84. The high voltage electrical wire 82 is connected to a high voltage power supply having a positive or negative voltage output of between 1000 and 25000 volts (not shown). The electrical grounding wire 66 may be connected to an earth ground by affixing said grounding wire through a suitable electrically insulated connector 86 and to an earth ground 88. Moreover, the inner snow tube 54 may be selectively grounded via electrical grounding wire 92 through an electrically insulating connector 94 to an earth ground 94. The inner snow tube 54 is constructed from tubular stainless steel and is wrapped in an electrically insulating tubular sheath or body 90, which serves as a dielectric coating. Connecting said snow tube 54 to each ground 94 as discussed above will produce an internal corona field (silent discharge) between 96 and the snow tube 54, through the dielectric insulator 90 and the charged electrical field generating ring 56. Increasing or decreasing the distance between the inner snow tube 54 and electric field generating ring 56 increases or decreases the electric field strength. Also increasing or decreasing the horizontal length of the electrical field generating ring 56 and snow tube 54 also increases or decreases the quantity of electrical power that can be applied to the electrical field generating ring 56 from the high voltage power supply (not shown).

The snow tube 54 is fed through an electrical insulating bulkhead fitting 97 and mated with a polymeric (PEEK) snow condensation tube 98 which communicates with the above referenced enhanced snow condensation and modification apparatus (not shown). The condensation tube can be of lengths from generally 12 to 120 inches and is preferably wrapped in a conductor 100 which is electrically grounded through a grounding wire 102 and communicated with an earth ground as shown. Similarly, the propellant delivery tube 104 may have varying lengths and is communicated with the above described propellant delivery and modification apparatus (not shown). The propellant tube 104 is preferably wrapped in a conductor 106 which is electrically grounded through a grounding wire 108 and communicated with an earth ground as shown.

The snow tube 54 optionally contains one or more conductive needle 110 which are located at the end of the snow tube 54 as shown and are sandwiched between the snow tube 54 and dielectric coating 90 as shown in the front end partial view. The needles 110 are useful for concentrating electrical field energy and discharging the energy into and between the needles 110 and inner mixing nozzle regions as discussed above or for directing the electric energy, under the influence of the supersonic propellant and snow spray mixture, into and between the needles 110 and substrate 78.

Finally, modified snow 112 is fed through the condensation tube 98 and into the inner conductive snow tube 54. Modified propellant 114 is fed through the propellant delivery tube 104, into the injection tee 58 and into the nozzle cavity 52. The two streams move through each respective coaxial compartment, being selectively and physicochemically modified by the corona electric field depending upon the nature of each stream's modified properties and are mixed within the nozzle mixing throat 116. The modified TIG-Snow stream, comprising reactive species, ozone, snow, abrasives and other modifiers in combination with a corona plasma jet (depending upon the above discussed grounding arrangement) are directed out of the mixing nozzle 76 and toward the substrate 78.

Figure 3:
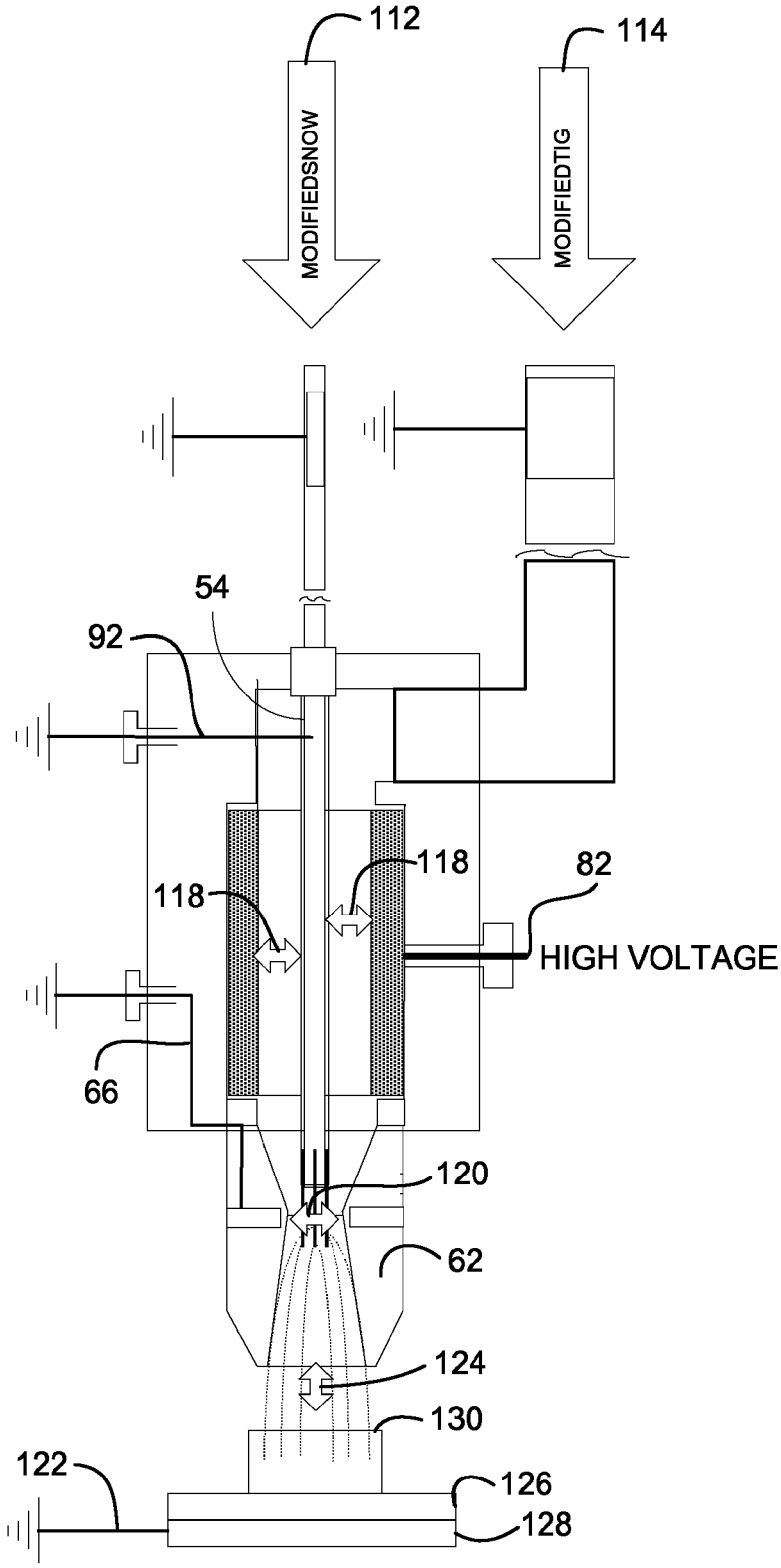
FIG. 3 is a schematic diagram of the exemplary dense fluid plasma generation.

FIG. 3 is a schematic diagram showing the various plasma fields that can be created using the exemplary dense fluid plasma nozzle described in FIG. 2. Connecting the exemplary electrical grounding wire 92 to each ground and energizing high voltage line 82 produces an electric field 118 between the grounded snow tube 54. The presence of an electric field in this region is useful for creating oxidizing radicals from radical forming agents contained in the propellant gas 114 which are then mixed with modified snow 112 within the mixing nozzle 62. Connecting the exemplary electrical grounding wire 66 to earth ground and energizing high voltage line 82 produces an electric field or corona discharge 120 within the mixing nozzle body 62. The presence of an electric field or corona plasma in this region is useful for creating oxidizing radicals from radical forming agents contained in either the propellant gas 114 or snow 112 to produce a mixture of modified TIG-Snow cleaning and modification spray. Finally, connecting the exemplary substrate grounding wire 122 to earth ground and energizing high voltage line 82 produces an electric field or corona discharge 120 within the region 124 between the mixing nozzle body 62 and the substrate 78 being treated. It is preferred that the substrate 78 be placed on top of an electrically insulation layer 126 which is placed onto a grounded conductor 128. The presence of an electric field or corona plasma in this region is useful for creating oxidizing radicals from radical forming agents contained in either the propellant gas 114 or snow 112 to produce a modified TIG-Snow cleaning and modification spray and to directly form oxidizing species on the substrate surface 130 being treated.

Figure 4:
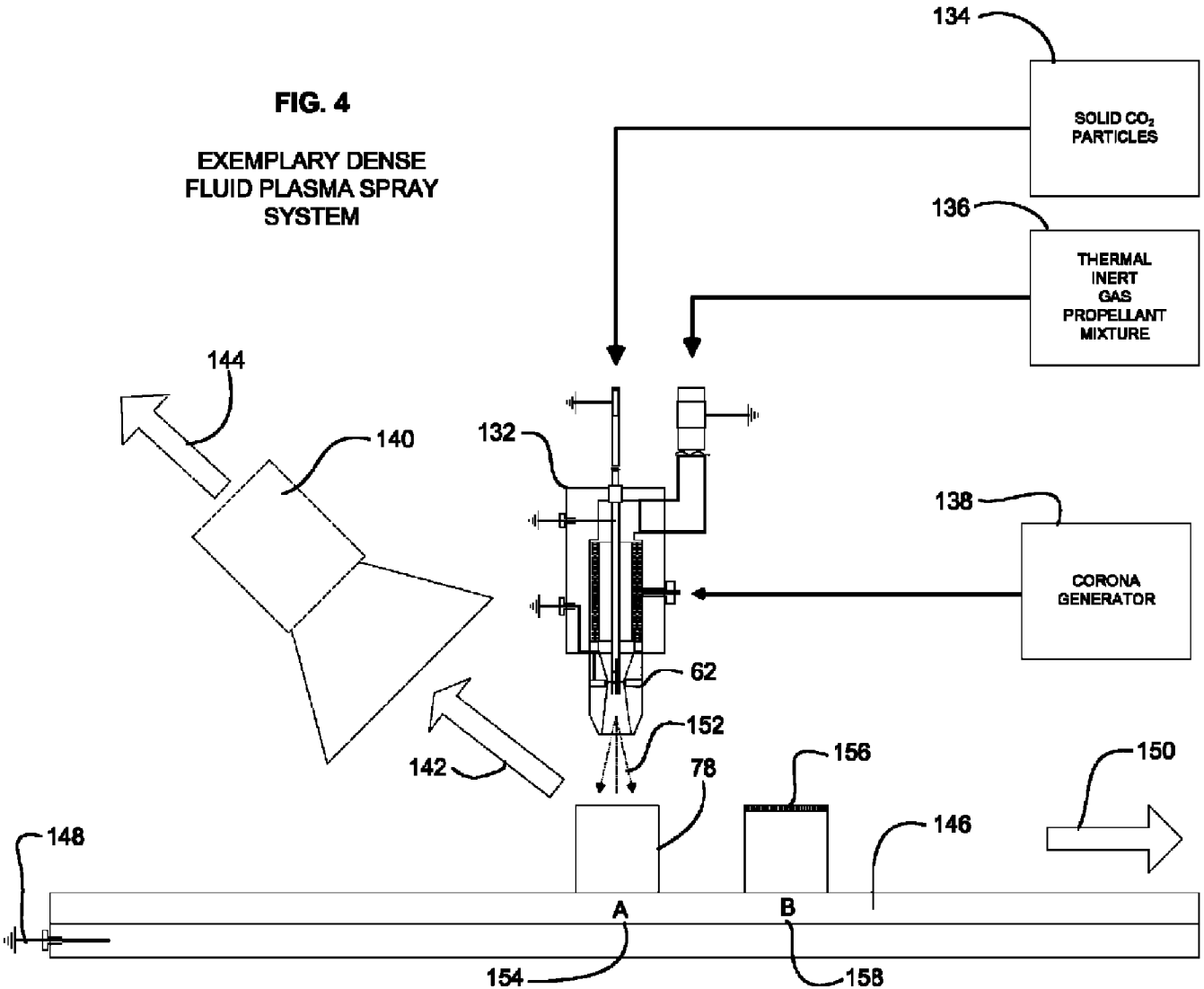
FIG. 4 is a schematic diagram of the exemplary dense fluid plasma spray system.

FIG. 4 is a schematic diagram of the exemplary dense fluid plasma spray system with various components described above. The exemplary dense fluid plasma spray system comprises the exemplary dense fluid plasma applicator 132, previously described above using FIG. 2 and FIG. 3. The plasma applicator 132 is connected to supply of modified solid carbon dioxide particles 134 and a supply of modified propellant gas 136. As noted above, both snow particles and propellant gas may be obtained using devices and processes previously invented by the present inventor. An exemplary high voltage power supply 138 for energizing the plasma applicator may be obtained from a number of sources as described above. Having connected the various components to the plasma applicator and grounding the plasma connector to obtain the desired electric field or corona plasma plume as described using FIG. 3, the treatment applicator is ready for operation. The exemplary system also comprises a fume extraction hood 140 which extracts 142 reacted/removed substrate surface contaminants using a vacuum source 144 and transports them to a suitable fume/dust filtration or treatment system (not shown). The exemplary substrate 78 may be placed on a moving conveyor 146 which is suitably grounded 148. The exemplary substrate 78 is moved 150 under the exemplary plasma applicator 132 and specifically under the cleaning and modification spray 152 at a predetermined distance from the mixing nozzle 62 and for a predetermined scan rate and dwell time. Using this scheme, the substrate is first spray treated within a cleaning and modification spray zone 154, following which the treated substrate 156 moves into, for example, a secondary substrate treatment zone 158 which may include adhesive dispensing, potting, painting, dispensing, filling, curing or other sequential operations.

Figure 5:
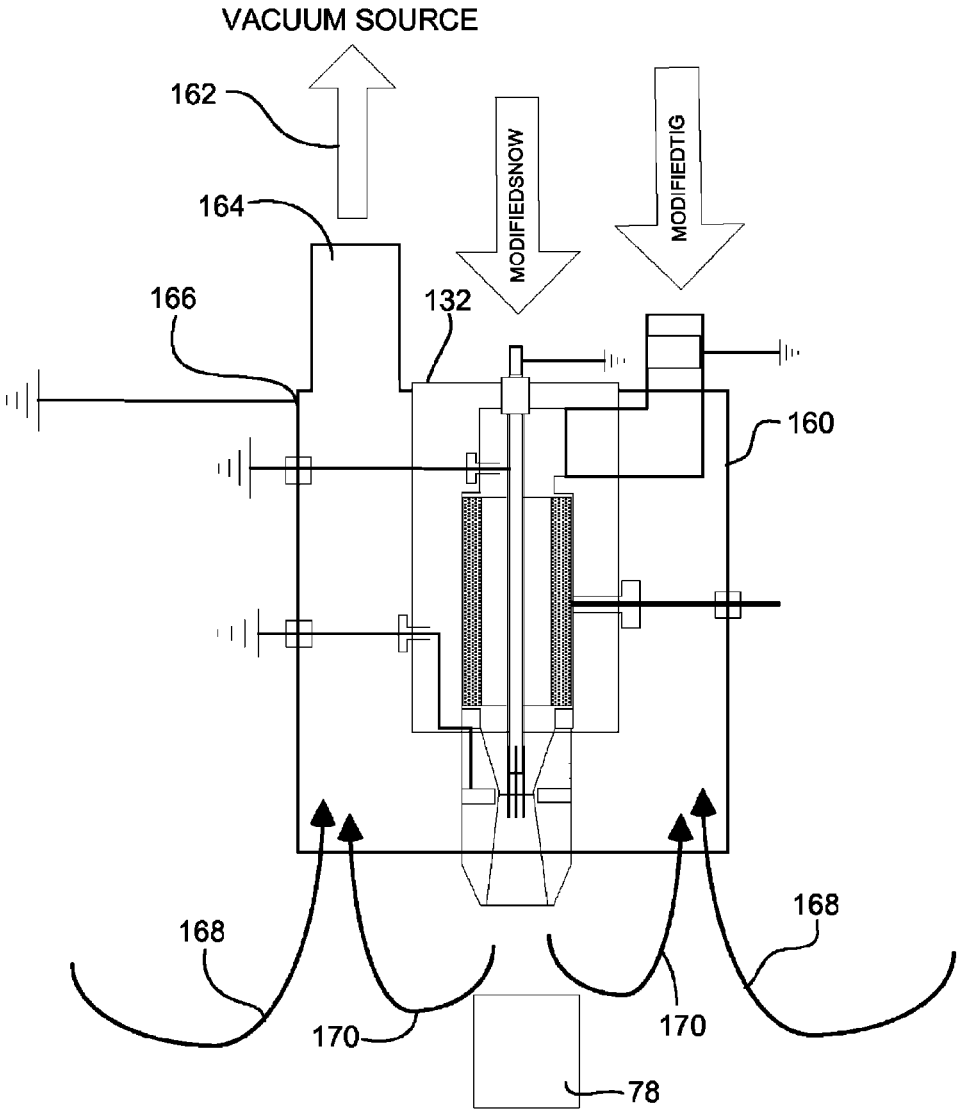
FIG. 5 is a schematic diagram of the exemplary dense fluid plasma spray extraction system.

FIG. 5 is a schematic diagram of an exemplary integrated dense fluid plasma spray and fume extraction shroud. This system shows the exemplary plasma applicator 132 with a circular electrically non-conducting shroud 160 surrounding said applicator, which is connected to a vacuum source 162 using a suitable housing connection 164. The exemplary extraction shroud may be further covered with a conductor such as stainless steel which is then grounded 166 to drain away excess electrostatic surface charge accumulating on the extraction hood 160. All necessary grounding elements and snow and propellant feed lines are brought through the extraction shroud as shown. Using the exemplary device, and during cleaning and modification spray operations on the exemplary substrate 78, the surrounding atmosphere 168 and treatment spray with reacted contaminants 170 are drawn up into the shroud under vacuum 162.

Figure 6:
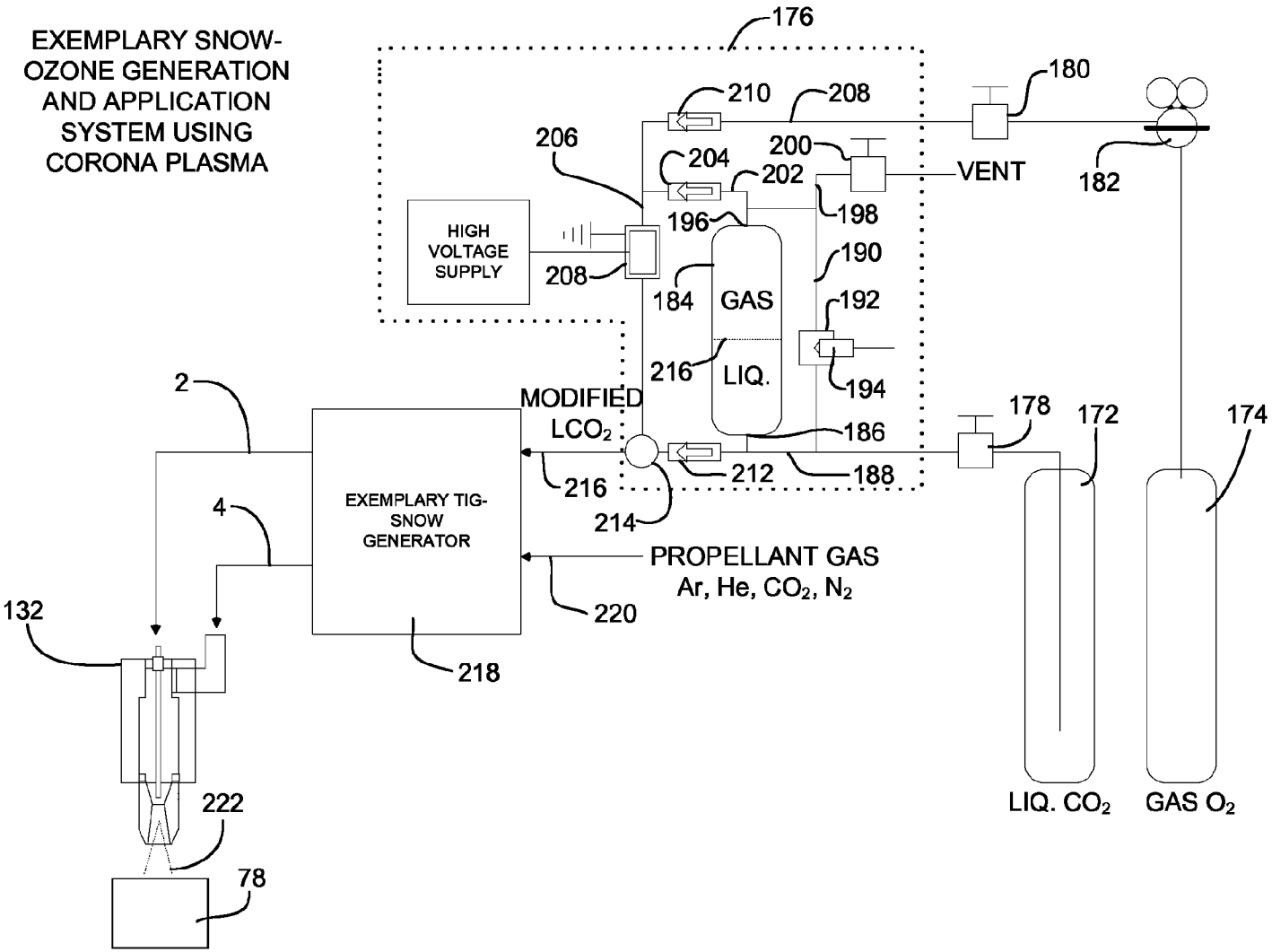
FIG. 6 is a schematic diagram of the exemplary dense fluid-ozone generation and application system using corona plasma.

FIG. 6 is a schematic diagram of an exemplary dense fluid-ozone generation and application system using corona plasma. Shown is the figure, a source of liquid carbon dioxide 172 and pressure regulated oxygen gas 174 are connected to a gas-liquid blending and ozonation system 176 using a liquid carbon dioxide feed valve 178, oxygen gas feed valve 180, and oxygen gas pressure regulator 182. The exemplary gas-liquid blending and ozonation system 176 comprises a gas/liquid storage tank 184 which is connected through a bottom hemisphere port 186 to the liquid carbon dioxide feed line 188. The bottom hemisphere port 186 is connected using a connecting pipe 190, and through a tee 192 housing an optical level switch 194, to the upper hemisphere port 196. The upper hemisphere port 196 is further connected to a gas bleed pipe 198 and gas bleed valve 200. The upper hemisphere port 196 is also connected to a gas blending feed pipe 202 and check valve 204 to oxygen-carbon dioxide blending pipe 206. Oxygen gas is fed into the exemplary gas-liquid blending and ozonation system 176 through a feed pipe 208 which is connected to the oxygen-carbon dioxide blending pipe 206 through a check valve 210. The gas blending pipe 206 connects to a corona generator 208 and out through an ozonation feed pipe 210. The ozonated feed pipe 210 connects to liquid carbon dioxide feed pipe 188 via a check valve 212 and using a mixing tee 214.

The exemplary dense fluid blending and ozonation system work as follows, producing a modified liquid carbon dioxide feed stream for use in the present invention. Liquid carbon dioxide is fed through a valve 178 and into the storage tank 184 by a opening bleed valve 200 until the optical sensor 194 determines that the storage tank is filled with liquid carbon dioxide to a predetermined level 216 within the storage tank 184, but below the corona generator system 208. Oxygen gas is fed through feed line 208 by opening valve 180 and regulating the pressure to be equal to the liquid carbon dioxide 172 feed pressure (typically 810-890 psi). Using this scheme, an approximately 50:50 mixture of gaseous carbon dioxide and gaseous oxygen are blended in the blending pipe 206 and into the corona treatment unit 208. Preferably, the entire blending and ozonation system 176 is self-contained and automated. For example, the optical sensor, working in concert with the bleed valve 200, maintains the liquid carbon dioxide level 216 within the storage tank 184 at all times. The corona treatment unit 208 is a novel high pressure AC or DC silent discharge system, described in more detail in a pending patent by the present inventor, which excites oxygen gas molecules contained in the oxygen-carbon dioxide gas mixture to produce an ozone-oxygen-carbon dioxide gas mixture. An electric field applied across a gap through a dielectric and ground metal surface produces a silent discharge. This silent discharge disassociates oxygen gas molecules which recombine as ozone molecules.

The ozonated gas mixture is connected to a tee 214, which is also connected to the liquid carbon dioxide feed pipe 188. This mixture is fed 216 into the exemplary TIG-Snow generator 218, previously described in U.S. Pat. No. '154, along with a supply of propellant gas 220. As described herein, the TIG-Snow generator produces the two component streams; modified snow particles 2 and propellant gas stream 4, which are contactively mixed within the exemplary applicator 132 and directed 222 toward a substrate 78 to be treated.

Figure 7:
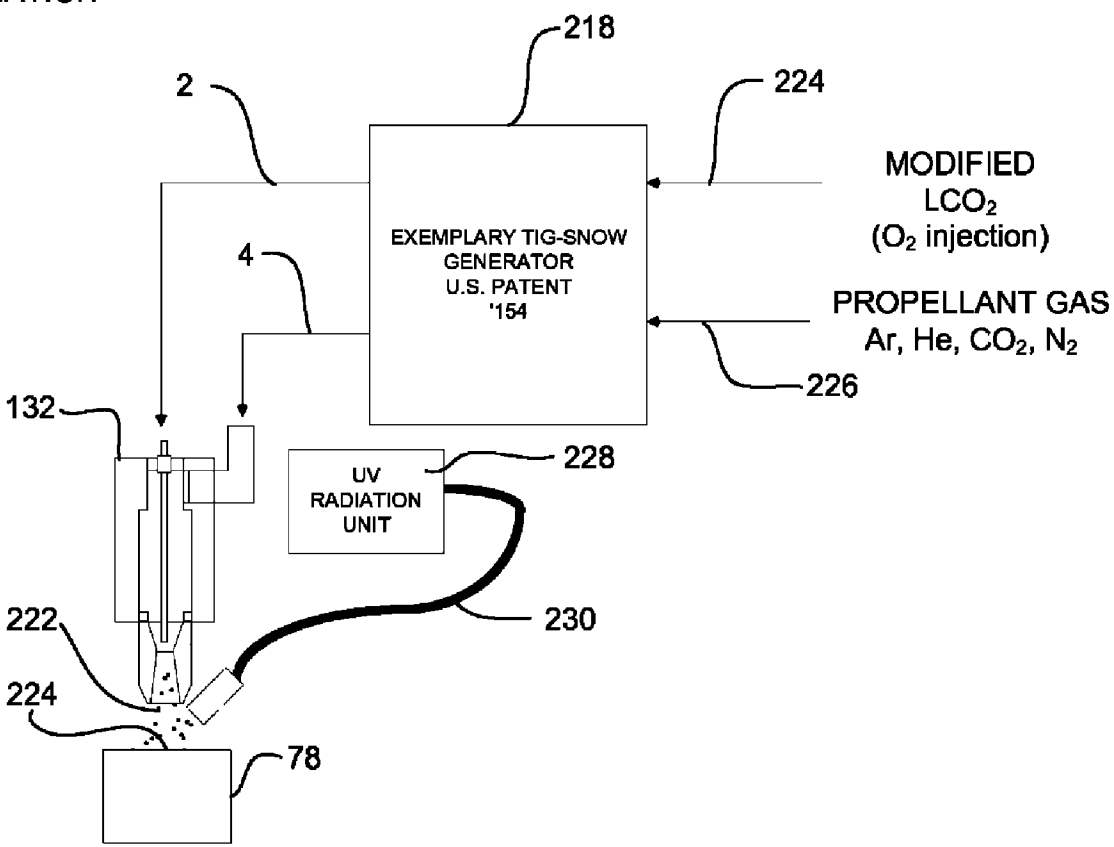
FIG. 7 is a schematic diagram of the exemplary dense fluid-ozone generation and application system using ultraviolet radiation.

FIG. 7 is a schematic diagram of an alternative exemplary dense fluid-ozone generation and application system using ultraviolet radiation. Shown in the figure, a source of modified liquid carbon dioxide 224 containing oxygen gas and a supply of pressure regulated propellant gas 226, as previously described above using FIG. 6, are connected to the exemplary TIG-Snow generator 218, previously described in U.S. Pat. No. '154. The modified liquid carbon dioxide has not been treated using a corona plasma generator as in FIG. 6 above as it is treated using ultraviolet radiation at the substrate 78 to produce the necessary ozone component. As described herein, the TIG-Snow generator produces the two component streams; modified snow particles 2 and propellant gas stream 4, which are contactively mixed within the exemplary applicator 132 and directed 222 toward a substrate 78 to be treated. In this embodiment, ultraviolet radiation is produced using a conventional UV curing system 228 and UV light delivery pipe 230 with output in the 100 to 400 nm spectrum. Oxygen contained in the TIG-Snow spray stream 222 absorbs radiation at a wavelength of 189.9 nm in transit and at the substrate-spray interface 224 as shown to produce a mixture of ozone-snow-propellant. The usefulness of this approach is that the UV curing device can be used for adhesive curing in subsequent bonding operations following surface treatment using the present invention.

Figure 8:
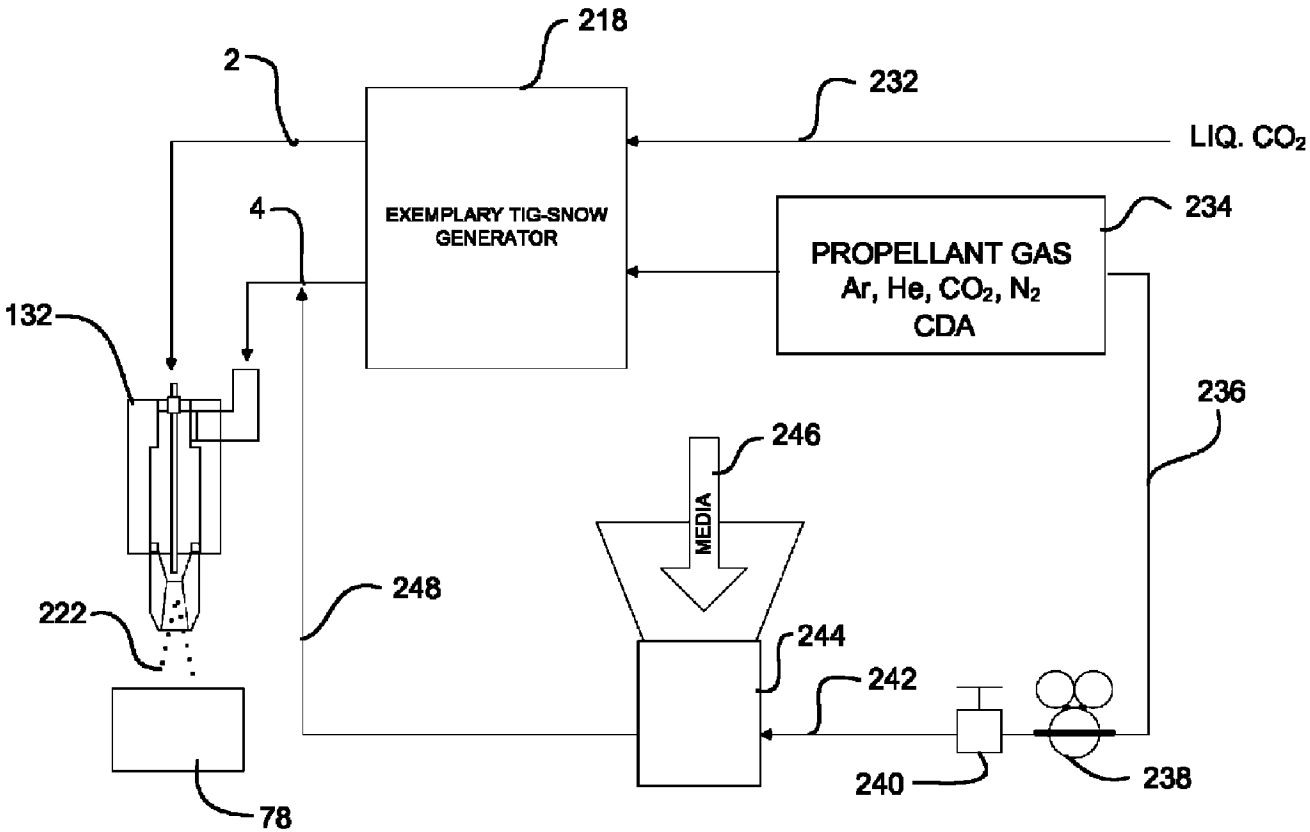
FIG. 8 is a schematic diagram of the exemplary dense fluid-microabrasive generation and application system.

FIG. 8 is a schematic diagram of the exemplary dense fluid-microabrasive generation and application system. Shown in the figure, a source of modified liquid carbon dioxide 224 containing one or more additives and a supply of pressure regulated propellant gas 234, are connected to the exemplary TIG-Snow generator 218, previously described in U.S. Pat. No. '154. As described herein, the TIG-Snow generator produces the two component streams; modified snow particles 2 and propellant gas stream 4, which are contactively mixed within the exemplary applicator 132. In this embodiment, microabrasive particles are added to a second propellant gas pipe 236, derived from the same or different gas supply source. The second propellant pipe 236 is pressure regulated using a suitable gas regulator 238 and feed valve 240 which is fed 242 into a abrasive particle injector 244. Micro abrasive media particles 246 such as silica, sodium carbonate, walnut shells and conductive plastics are fed into the second propellant stream and the mixture of propellant and particles is fed 248 into the first propellant stream 4. The resulting mixture of modified snow particles and modified propellant gas containing abrasive particles is sprayed 222 at the exemplary substrate 78 to be treated. The usefulness of this embodiment is derived as follows. The abrasive particle feed may be selectively turned on and off to allow the TIG-Snow spray mixture to remove ablated surface contamination and residual abrasive particles. Moreover, the TIG-Snow spray may be used to either cool or heat a substrate surface contamination prior to microabrasive treatment to aid to hardening or softening, respectively, the surface contamination.

Figures 9A, 9B, 9C:
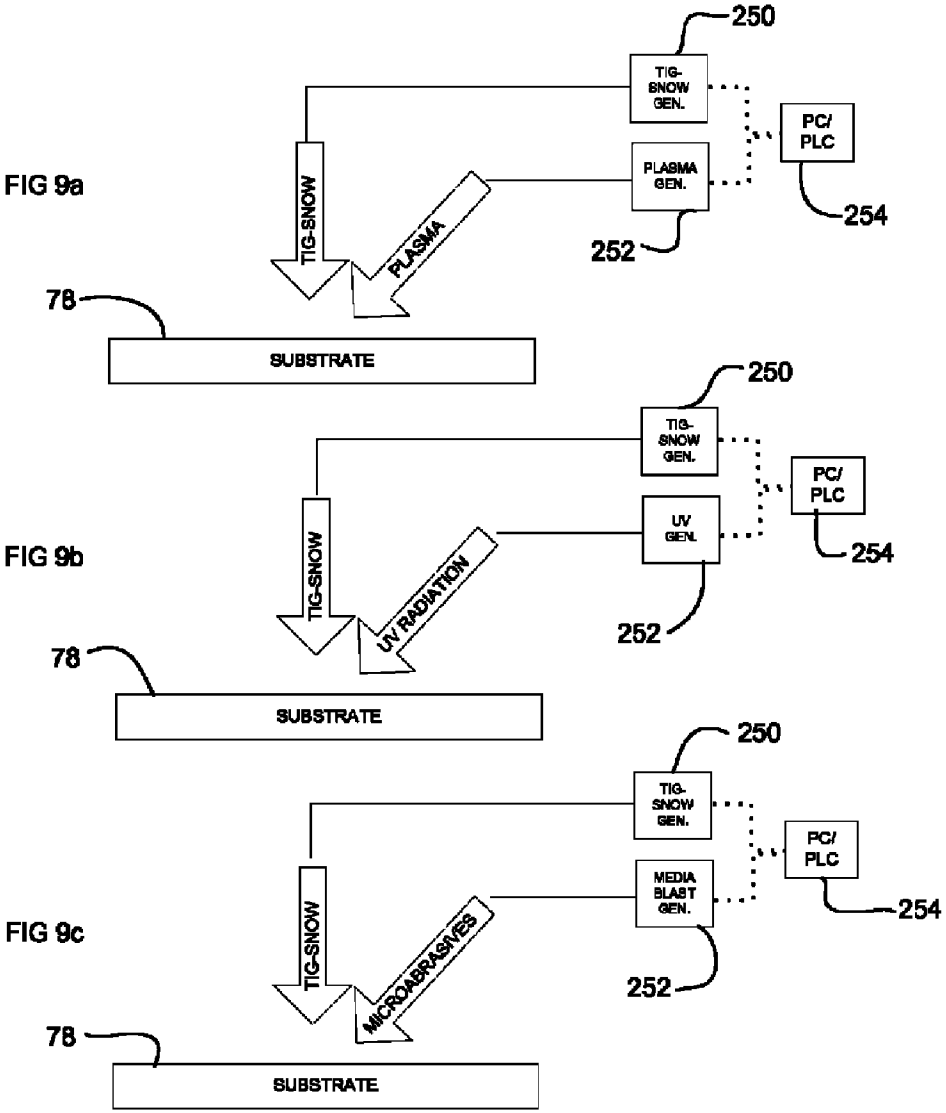
FIG. 9*a* is a schematic diagram of the exemplary alternative dense fluid surface cleaning and modification using a conventional corona plasma treatment device in combination with a dense fluid spray.
FIG. 9*b* is a schematic diagram of the exemplary alternative dense fluid surface cleaning and modification using a conventional pulsed ultraviolet curing device in combination with a dense fluid spray.
FIG. 9*c* is a schematic diagram of the exemplary alternative dense fluid surface cleaning and modification using conventional microabrasive surface treatment device in combination with a dense fluid spray.

FIGS. 9*a*, 9*b*, and 9*c* schematically represent various methods to combine conventional, but heretofore, independent surface cleaning and surface modification technologies into much more useful cleaning and surface modification tools. Although presented separately, these methods may be further combined into one of more method combinations to clean and prepare a substrate surface for bonding operations.

FIG. 9*a* is a schematic diagram of the exemplary alternative dense fluid surface cleaning and modification method using a conventional corona plasma treatment device in combination with a dense fluid spray. As shown in the figure, the exemplary substrate 78 may be cleaned and modified sequentially or in combination, in accordance with the novel processes, methods and apparatus described herein, using a conventional snow spray or pellet carbon dioxide spray cleaning device 250, available from Deflex Corporation, Valencia, Calif., with a surface plasma treatment device 252, available from Tri-Star Technologies, El Segundo, Calif. Using this approach, the method of applying modified TIG-Snow spray streams in combination with a corona plasma surface treatment may be accomplished. A PC/PLC control system and software 254 may be used to automate the operation of both systems, as well as provide automation of a substrate conveyance system (not shown).

FIG. 9*b* is a schematic diagram of the exemplary alternative dense fluid surface cleaning and modification using a conventional pulsed ultraviolet curing device in combination with a dense fluid spray. As shown in the figure, the exemplary substrate 78 may be cleaned and modified sequentially or in combination, in accordance with the novel processes, methods and apparatus described herein, using a conventional snow spray or pellet carbon dioxide spray cleaning device 250, available from Deflex Corporation, Valencia, Calif., with an ultraviolet curing device 256, available from Xenon Corporation, Woburn, Mass. Using this approach, the method of applying modified TIG-Snow spray streams in combination with a ultraviolet radiation treatment may be accomplished. A PC/PLC control system and software 254 may be used to automate the operation of both systems, as well as provide automation of a substrate conveyance system (not shown).

FIG. 9*c* is a schematic diagram of the exemplary alternative dense fluid surface cleaning and modification using conventional microabrasive surface treatment device in combination with a dense fluid spray. As shown in the figure, the exemplary substrate 78 may be cleaned and modified sequentially, in accordance with the novel processes, methods and apparatus described herein, using a conventional snow spray or pellet carbon dioxide spray cleaning device 250, available from Deflex Corporation, Valencia, Calif., with a microabrasive blast treatment device 258, available from Comco Systems, Burbank, Calif. Using this approach, the method of applying modified TIG-Snow spray streams in combination with a microabrasive surface treatment may be accomplished in a sequential manner. A PC/PLC control system and software 254 may be used to automate the operation of both systems, as well as provide automation of a substrate conveyance system (not shown).

Although the invention has been disclosed in terms of preferred embodiments, it will be understood that numerous variations and modifications could be made thereto without departing from the scope of the invention as set forth herein.

The invention claimed is:

1. A method of forming a plasma to physicochemically modify properties of a fluid spray in a substrate treatment processes, the method comprising:

providing a substrate to be treated;

providing an applicator in proximity to the substrate, the applicator comprising:

an electrically insulated main body portion containing a cavity therethrough;

a tube axially positioned within the cavity of the main body portion for transporting a first fluid;

an annular electric-field generator positioned within the cavity between the main body portion and the tube;

a region between the tube and the generator for transporting a second fluid; and a convergent-divergent nozzle connected to the main body portion for mixing the first fluid with the second fluid and directing the resulting fluid spray onto a substrate;

grounding the tube, the nozzle or the substrate;

supplying the tube with the first fluid;

supplying the region with the second fluid; and activating the electric-field generator to form the plasma to physicochemically modify properties of the first fluid, the second fluid or the fluid spray, wherein the plasma is formed within or about the region between the tube and the generator when the tube is grounded, wherein the plasma is formed within the nozzle when the nozzle is grounded, wherein the plasma is formed between the nozzle and the substrate when the substrate is grounded.

2. The method of claim 1 wherein the applicator further includes a non-conductive spacer positioned between the generator and the nozzle.

3. The method of claim 1 wherein the nozzle is constructed of semi-conductive material, the plasma being formed within a convergent portion of the nozzle.

4. The method of claim 1 wherein the nozzle is constructed of a non-conductive material, the plasma being formed between a nozzle opening and the substrate.

5. The method of claim 1 wherein the plasma is selectively formed within the tube or between the nozzle and the substrate when or about the region between the tube and the generator and the substrate are grounded.

6. The method of claim 5 wherein the nozzle is conductive.

7. A method of forming a plasma to physicochemically modify properties of a fluid spray in a substrate treatment processes, the method comprising:

providing an applicator, the applicator comprising:

an electrically insulated main body portion containing a cavity therethrough;

a tube axially positioned within the cavity of the main body portion for transporting a first fluid;

an annular electric-field generator positioned within the cavity between the main body portion and the tube;

a region between the tube and the generator for transporting a second fluid; and a nozzle connected to the main body portion for mixing the first fluid with the second fluid and directing the resulting fluid spray onto a substrate;

grounding the tube;

grounding the nozzle;

supplying the tube with the first fluid;

supplying the region with the second fluid; and activating the electric-field generator whereupon a plasma is formed within the nozzle, within or about the region between the tube and the generator.

8. The method of claim 7 wherein the nozzle is constructed of semi-conductive material, the plasma being formed within a convergent portion of the nozzle.

9. The method of claim 7 wherein the nozzle is constructed of a non-conductive material, the plasma being formed between a nozzle opening and the substrate.

10. The method of claim 7 and further comprising grounding the substrate, wherein the plasma is formed between the nozzle and the substrate.

11. A method of forming a plasma to physicochemically modify properties of a fluid spray in a substrate treatment processes, the method comprising:

providing a substrate to be treated;

providing an applicator in proximity to the substrate, the applicator comprising:

an electrically insulating main body portion containing a through-bore;

an electrically insulated tube centrally positioned within the main body portion for transporting a first fluid;

an annular electric-field generator positioned within the main body portion;

a region between an outer wall of the tube and the generator for transporting a second fluid; and a convergent-divergent nozzle positioned for receiving the first fluid and the second fluid to form the fluid spray;

grounding the nozzle;

supplying the tube with the first fluid;

supplying the region with the second fluid;

mixing the first fluid with the second fluid within the nozzle to form the fluid spray; and activating the electric-field generator to form the plasma within the nozzle, the plasma modifying the first fluid, the second fluid or the fluid spray.

12. The method of claim 11 wherein the substrate is supported by a grounded conductor, wherein activating the electric-field generator the plasma is formed between the nozzle and the grounded conductor to modify the fluid spray.

13. The method of claim 11 and further comprising grounding the tube, wherein activating the electric-field generator the plasma is formed within or about the region between the tube and the generator.

* * * * *